United States Patent [19]

Vanderjagt

[11] Patent Number: 4,614,481

[45] Date of Patent: Sep. 30, 1986

[54] PUMP WITH REPLACEABLE CARTRIDGE

[76] Inventor: John A. Vanderjagt, 1395 Glen Oaks, Memphis, Tenn. 38117

[21] Appl. No.: 742,900

[22] Filed: Jun. 10, 1985

[51] Int. Cl.[4] ..... F04B 35/04; F04B 49/00

[52] U.S. Cl. ..... 417/270; 417/271; 222/383

[58] Field of Search ..... 417/271, 270, 269; 222/383, 270

[56] References Cited

U.S. PATENT DOCUMENTS

| | | | |
|---|---|---|---|
| 2,381,056 | 8/1945 | Huber | 417/269 |
| 2,834,299 | 5/1958 | Coffey | 417/471 |
| 2,990,781 | 7/1961 | Tuck et al. | 417/270 |
| 3,010,403 | 11/1961 | Zubaty | 417/269 |
| 3,082,693 | 3/1963 | Budzich | 417/270 |
| 3,746,476 | 7/1973 | Bradley | 417/454 |
| 3,754,842 | 8/1973 | Schlanzky | 417/269 |
| 3,821,922 | 7/1974 | Kouns | 417/454 |
| 3,953,154 | 4/1976 | Wanner | 417/270 |
| 4,105,369 | 8/1978 | McGlocklin | 417/269 |
| 4,153,391 | 5/1979 | Hartley | 417/271 |
| 4,195,970 | 4/1980 | Zalis | 417/269 |
| 4,466,339 | 8/1984 | Huddle | 417/395 |
| 4,486,151 | 12/1984 | Korhonen-Wesala | 417/566 |
| 4,507,058 | 3/1985 | Schoenmeyr | 417/271 |
| 4,545,735 | 10/1985 | Ims | 222/383 |

FOREIGN PATENT DOCUMENTS

| | | | |
|---|---|---|---|
| 965301 | 4/1975 | Canada | 417/269 |

*Primary Examiner*—William L. Freeh

*Attorney, Agent, or Firm*—Walker & McKenzie

[57] ABSTRACT

A pump of the diaphragm type. The pump has a replaceable unitary cartridge which fits into a cavity of the pump casing. The casing is in two parts, an upper casing and a lower casing, which are held together by detachable means for replacing the cartridge.

9 Claims, 30 Drawing Figures

FIG. 14
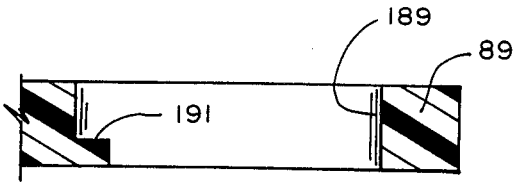
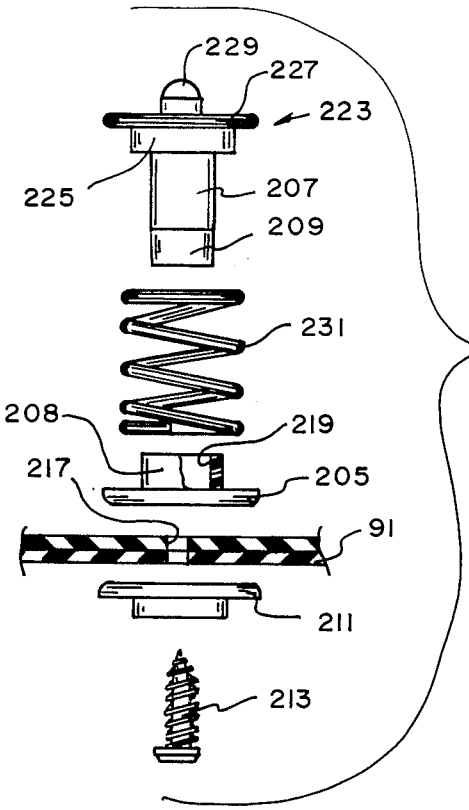
FIG. 15
FIG. 16
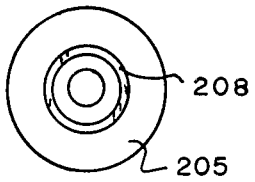
FIG. 20
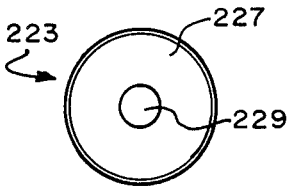
FIG. 17
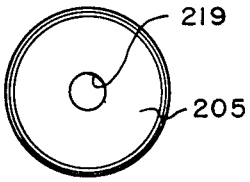
FIG. 18
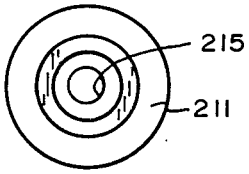
FIG. 21
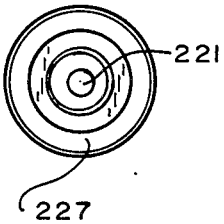
FIG. 22
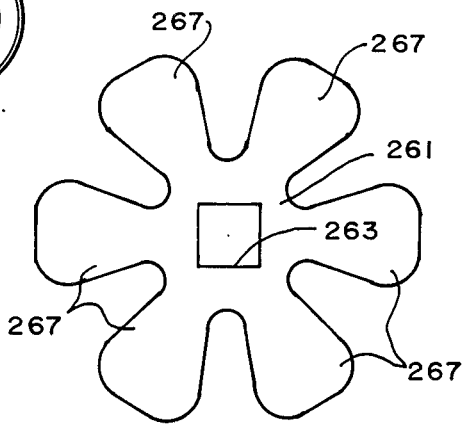
FIG. 19
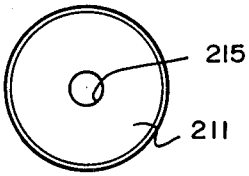

PUMP WITH REPLACEABLE CARTRIDGE

BACKGROUND OF THE INVENTION

1. Field of the Invention

The present invention relates to a diaphragm pump having a replaceable cartridge of the type for pumping heavy viscous chemicals and the like.

2. Description of the Prior Art

Heretofore, the usual type of diaphragm pump was arranged so that the parts of the pump including the casing were assembled together whereby when the pump was worn out, it had to be replaced with a complete new pump.

SUMMARY OF THE INVENTION

The present invention is directed toward providing an improved pump for pumping heavy viscous chemicals and the like, which pump includes a unitary cartridge means that can quickly and easily be replaced without the necessity of replacing the complete pump when the cartridge means becomes worn.

The pump of the present invention comprises, in general, a unitary cartridge means for pumping heavy viscous chemicals and the like, casing means including a lower casing and an upper casing, motor means including a rotatable shaft, non-rotatable swash plate means attached to the rotatable shaft, means attaching the motor means to the upper casing, and means detachably coupling the upper casing and the lower casing together to establish a hollow cavity in the casing means removably containing the unitary cartridge means with the swash plate means freely engaging the unitary cartridge means for the actuation thereof.

One of the objects of the present invention is to provide a pump for heavy viscous chemicals which includes unique means for constructing such a pump that has a unitary cartridge means containing the diaphragm pump per se and means for quickly and easily removing the cartridge means for the replacement thereof.

A further object is to provide such a pump which includes a two-part casing and means detachably coupling the parts of the casing together to establish a cavity receiving the cartridge means.

A further object is to provide such a pump in which one of the parts of the casing has motor means and swash plate means attached thereto and the other part of the casing has an inlet and outlet means attached thereto and is adapted to be attached to a container of the viscous chemicals and the like.

BRIEF DESCRIPTION OF THE DRAWINGS

FIG. 14 is an enlarged sectional view taken as on the line XIV—XIV of FIG. 9.

FIG. 15 is an exploded view of one of the piston means of the pump means, shown in relationship to the diaphragm means.

FIG. 16 is a top view of the upper head means of a piston means.

FIG. 17 is a bottom view of that shown in FIG. 16.

FIG. 18 is a bottom view of the lower head means of one of the piston means.

FIG. 19 is a top view of that shown in FIG. 18.

FIG. 20 is a top view of the upper portion of one of the piston means.

FIG. 21 is a bottom view of that shown in FIG. 20.

FIG. 22 is a plan view of the inlet valve means.

DESCRIPTION OF THE PREFERRED EMBODIMENT

Figure 1:
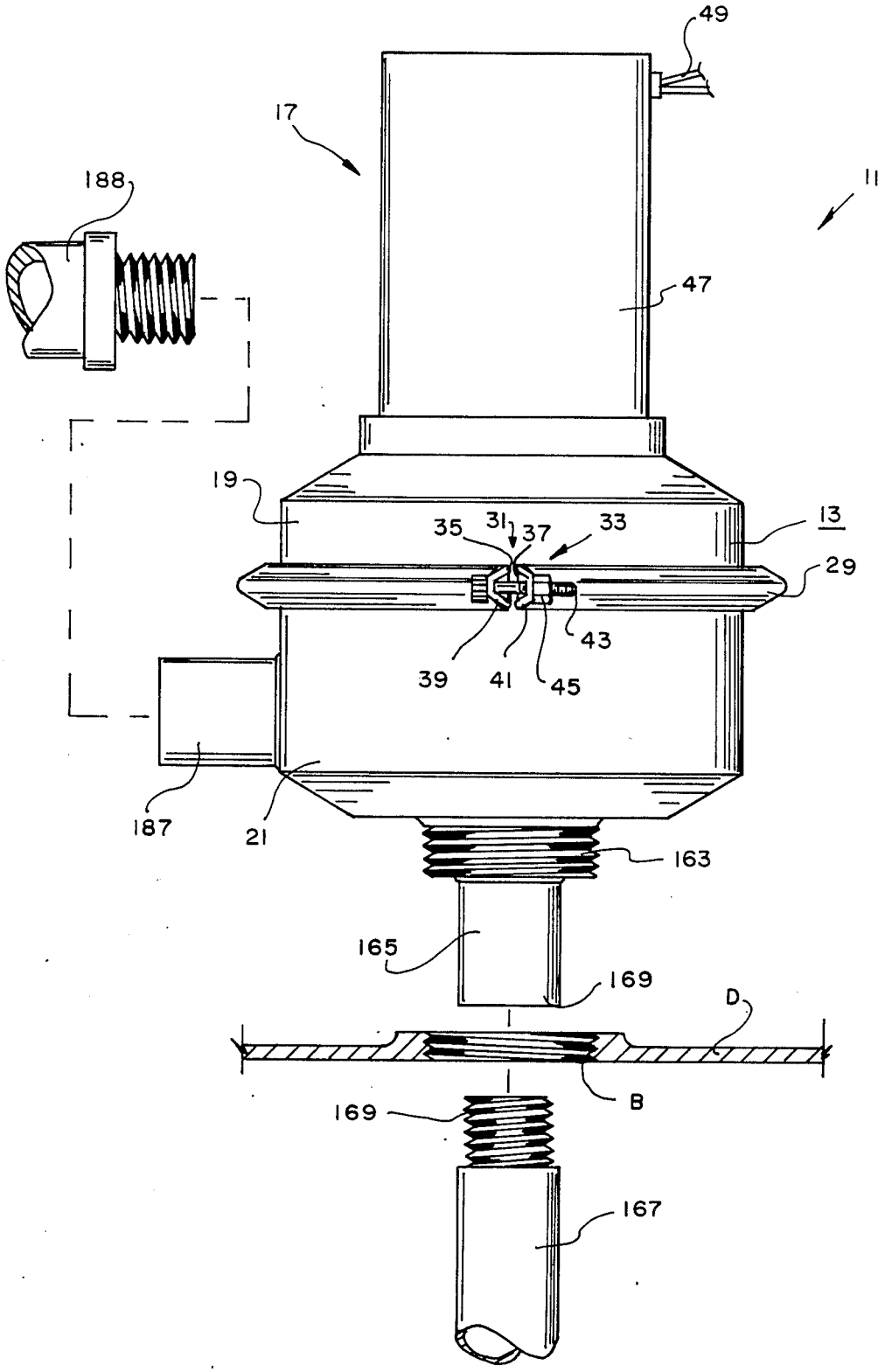
FIG. 1 is an exploded view of the pump of the present invention showing means for the connection thereof to a container and to a discharge hose.

The pump 11 of the present invention includes, in general, a casing 13, a unitary cartridge 15 removably received in casing 13, and driving means 17.

Casing 13 is preferably in two parts, namely an upper casing 19 and a lower casing 21. Casing 13 is preferably substantially cylindrical and is preferably formed of stainless steel or the like. Casing 13 is hollow on the interior thereof to establish a cavity 23 for receiving cartridge 15.

Upper casing 19 is provided with a peripheral outwardly extending flange 25 and lower casing 21 is provided with a corresponding peripheral flange 27 at the upper edge of lower casing 21 which mates with flange 25.

Means is provided for detachably coupling flanges 25, 27 together and which means preferably comprises a stainless steel band 29 which is interrupted as at 31. The clamping device 33 is provided for urging the ends 35, 37 together to cause clamping of the steel band 29 onto the flanges 25, 27. Clamping device 33 includes a lug 39 fixedly attached to end 35 and a lug 41 fixedly attached to the end 37, as by welding or the like, and extending outwardly therefrom. Also, clamping device 33 preferably includes a bolt 43 extending through apertures, not shown, respectively in lugs, 39, 41 and a nut 45 threadedly engaged on the bolt 43 to produce the above-mentioned clamping.

Driving means 17 includes a motor 47 of any suitable construction such as an electric motor driven by a suitable power source, not shown, well known to those skilled in the art with the electricity being fed to the motor 47 as through the electric cord 49. A suitable switch, not shown, well known to those skilled in the art is preferably provided for turning motor 47 off and on. Motor 47 includes a rotatable shaft 51. Motor 47 is fixedly secured to upper casing 19 by suitable means, as by bolts 53 extending upwardly through apertures 55 in upper casing 19 and threaded into a motor support 57 to which the motor 47 is fixedly attached. There is provided suitable bearing means 59 for shaft 51 which extends downwardly through central aperture 61 provided in upper casing 19. The shaft 51 which is located centrally relative to casing 13 extends downwardly into the inside of upper casing 19.

Figure 2:
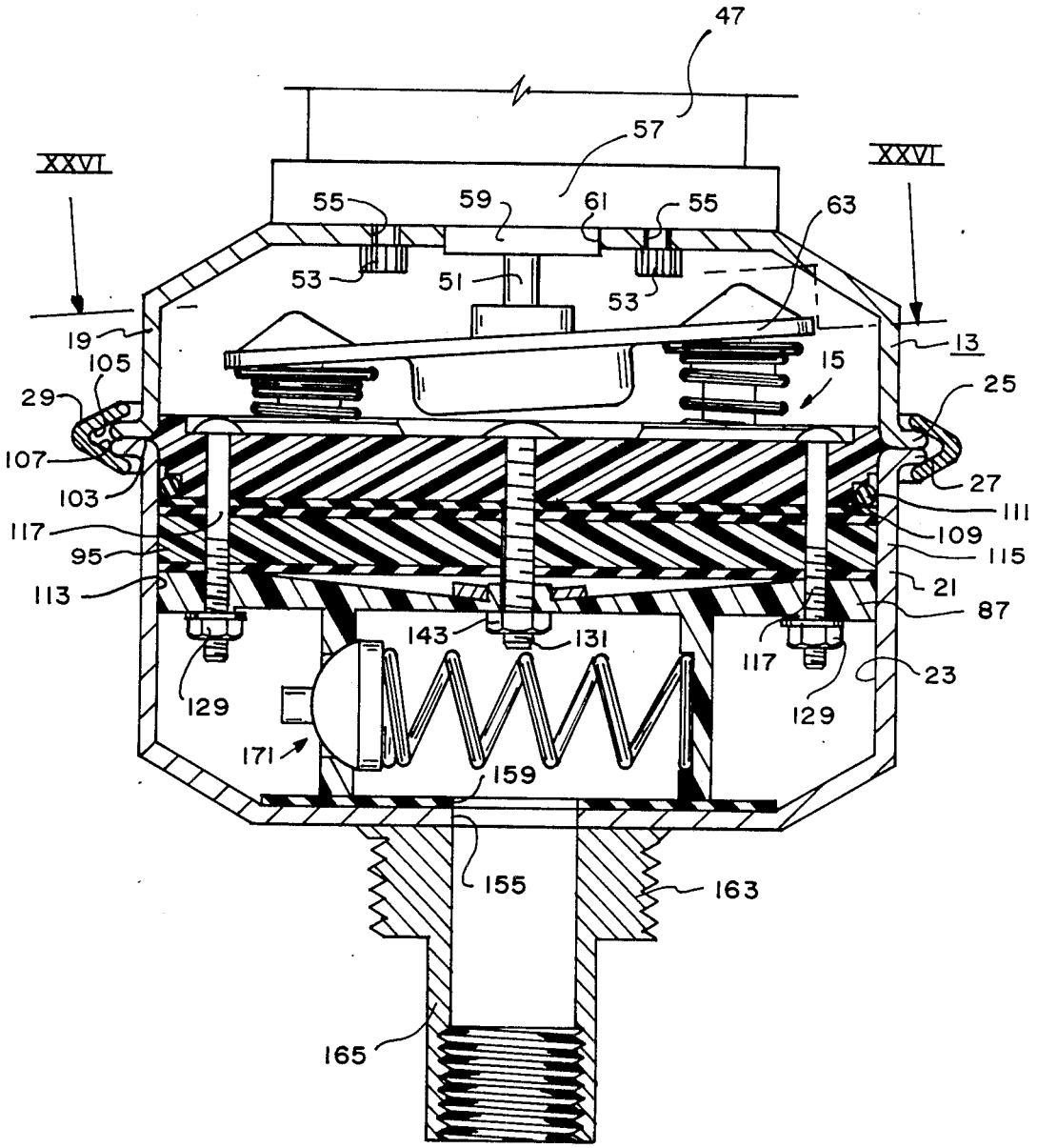
FIG. 2 is an enlarged sectional view taken as on the line II—II of FIG. 26, and including the upper portion of the pump not shown in FIG. 26.
Figure 3:
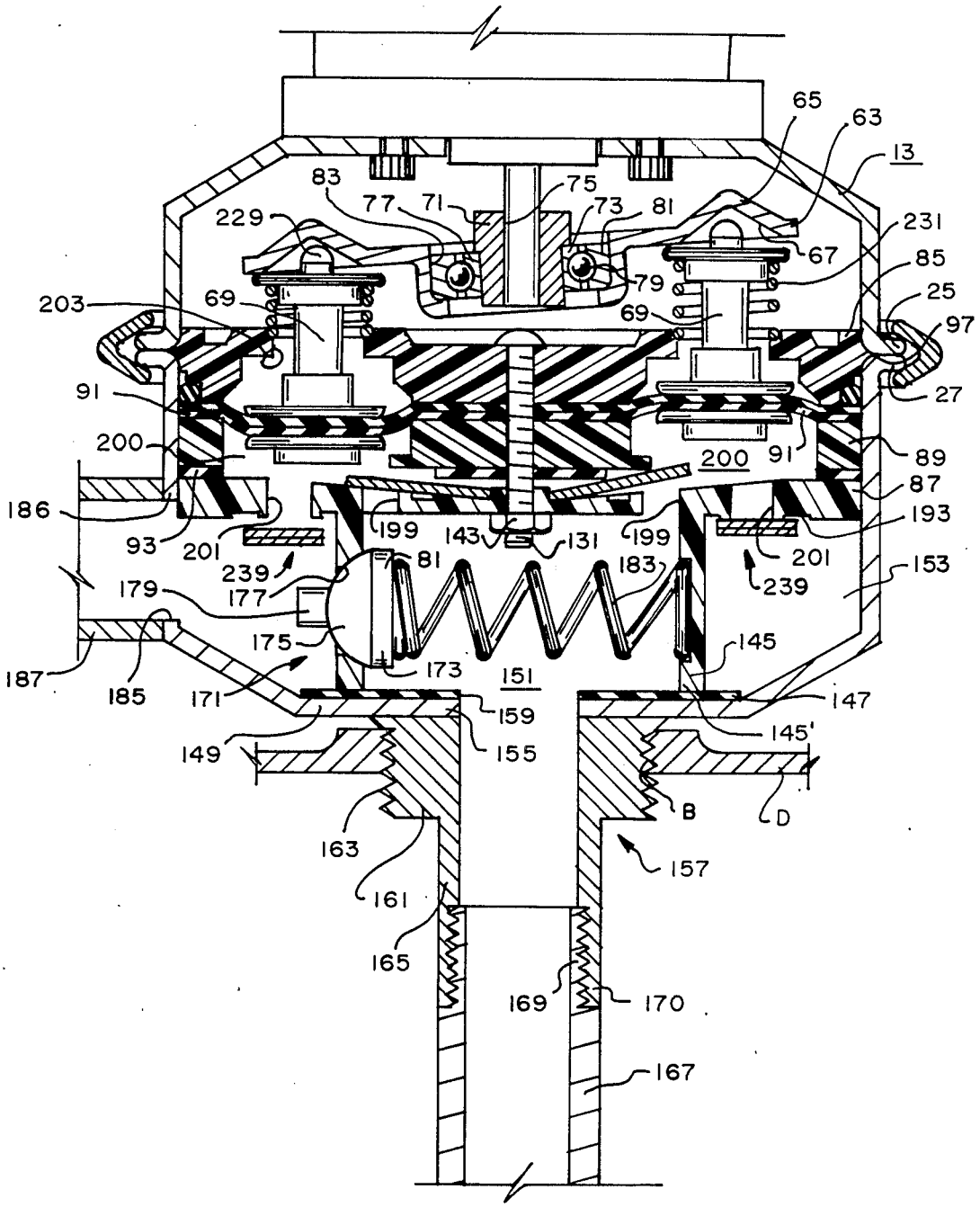
FIG. 3 is an enlarged sectional view taken as on line III—III of FIG. 26, including the upper portion of the pump not shown in FIG. 26 and with parts being removed for purposes of illustration.
Figure 4:
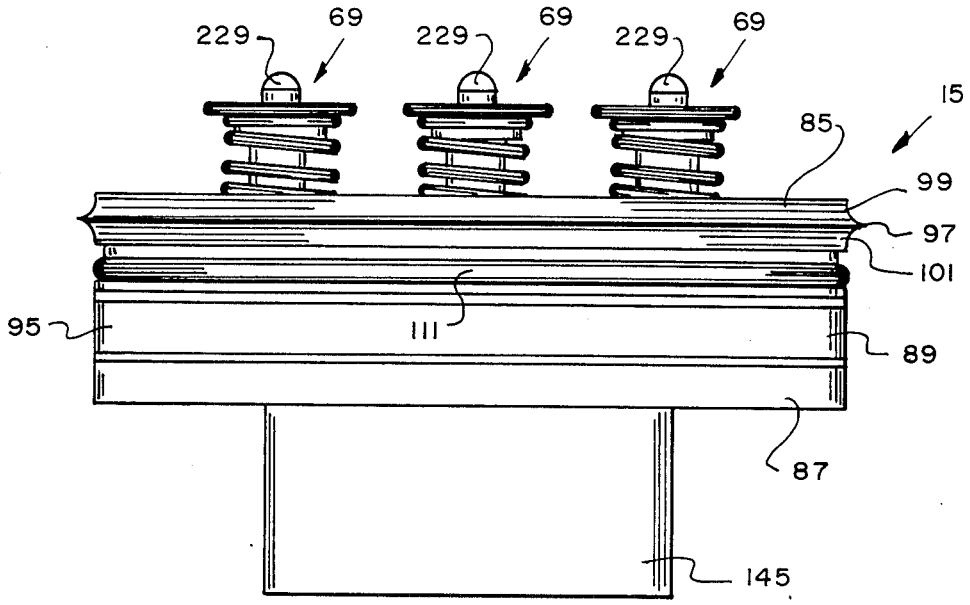
FIG. 4 is a side elevational view of the cartridge.
Figure 5:
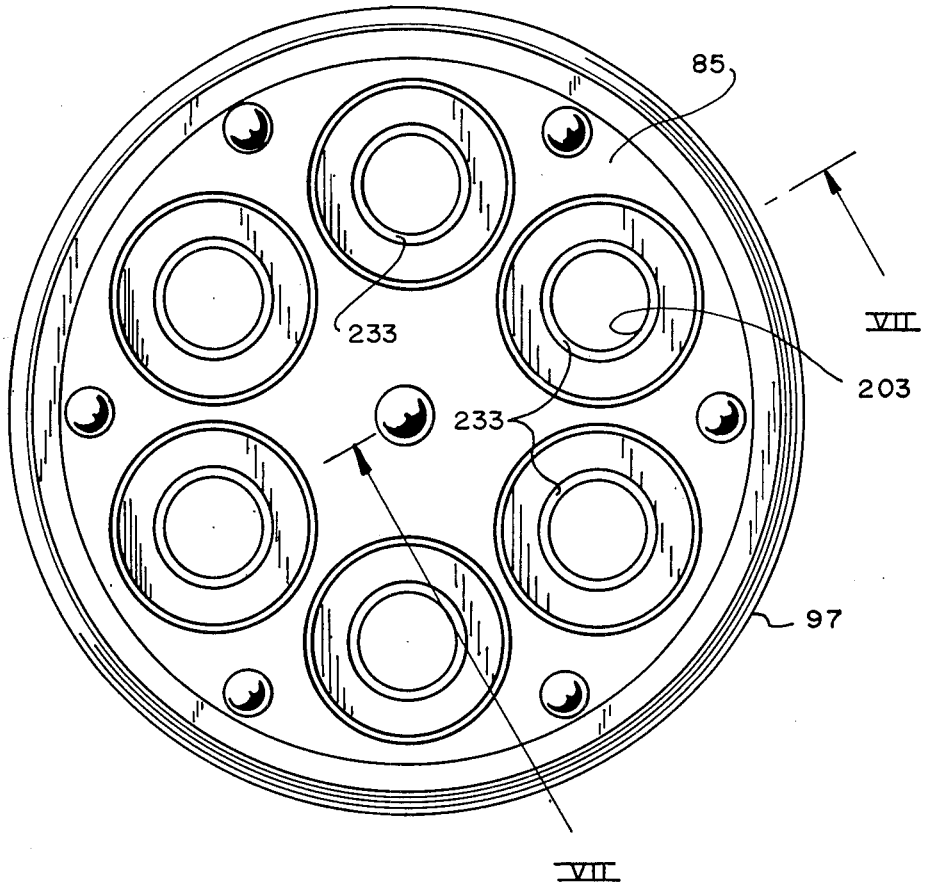
FIG. 5 is a top plan view of the upper plate of the cartridge.
Figure 26:
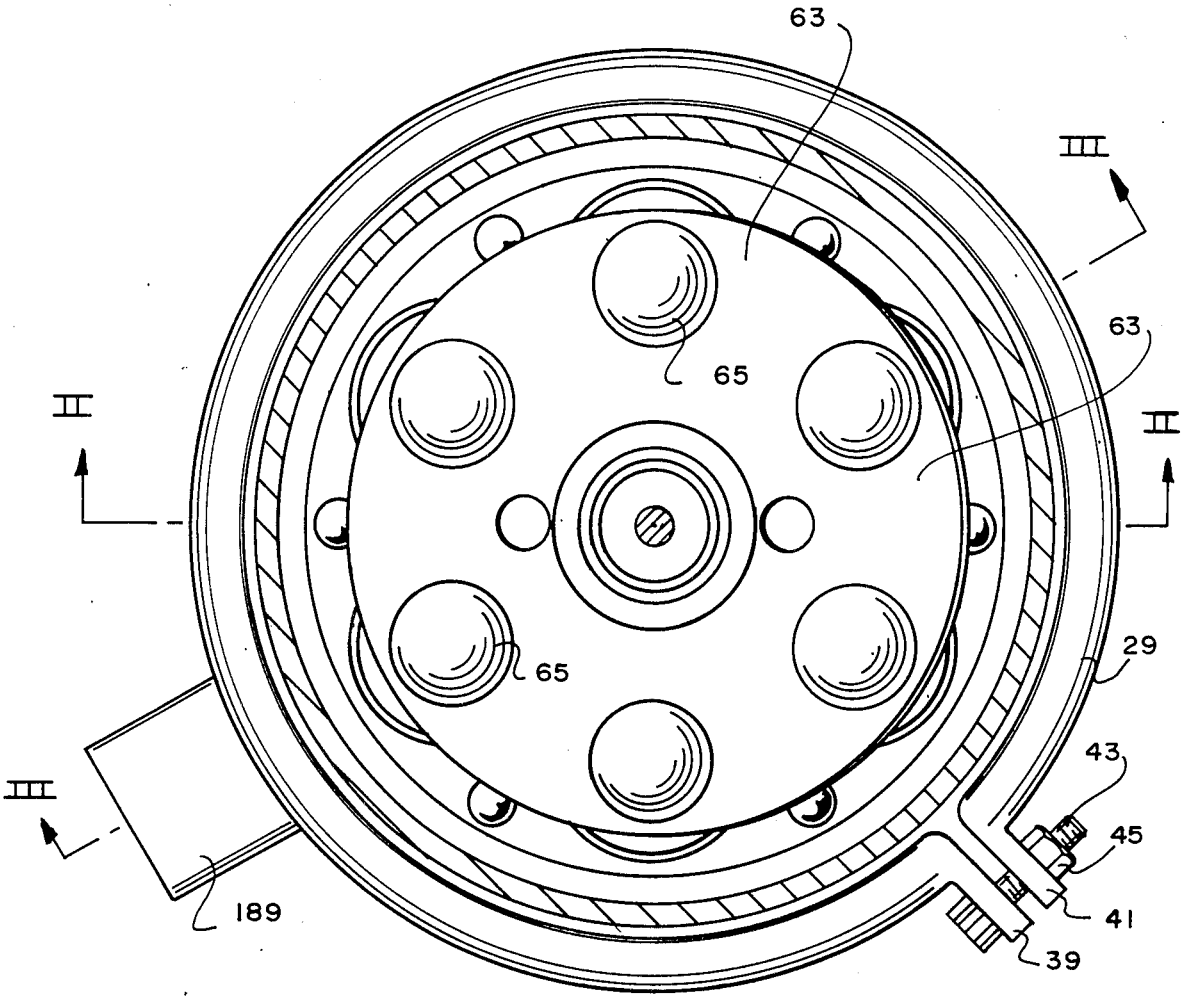
FIG. 26 is a sectional view taken as on the line XXVI—XXVI of FIG. 2.

Driving means 17 also includes a swash plate 63 (see FIGS. 2, 3 and 26). Swash plate 63 has a plurality of raised or dimpled portions 65 to establish a plurality of downwardly opening sockets 67 spaced around swash plate 63 and corresponding with the location of piston means 69 of cartridge 15 so that the swash plate 63 is adapted to fit down on top of piston means 69 respectively. Swash plate 63 is mounted on shaft 51. The means for mounting swash plate 63 on shaft 51 preferably includes a hub 71 which has a cylindrical outer surface 73 that has its axis tilted relative to the axis of the central bore 75 of hub 71. Hub 71 is fixedly mounted on shaft 51 by suitable means well known to those skilled in the art and has an inner race 77 of ball bearing means 79 fixedly attached thereto. The outer race 81 of ball bearing means 79 is fixedly attached to swash plate 63 by suitable means as by press fitting the race 81 in the central recessed portion 83 of swash plate 63.

Cartridge 15 is generally cylindrical and includes an upper plate 85, a lower plate 87 and an intermediate plate 89. A flexible diaphragm means 91 is sandwiched between upper plate 85 and intermediate plate 89. Diaphragm means 91 is preferably of double thickness, i.e., two separate identical pairs for longer lasting service. A first gasket 93 is sandwiched between intermediate plate 89 and lower plate 87. The outer peripheral portion of intermediate plate 89, flexible diaphragm 91, first gasket 93 and lower plate 87 form a substantially cylindrical sidewall 95, slightly smaller in diameter than the inside diameter of casing 13. Upper plate 85 is provided with a relatively thin peripheral edge 97, is provided with an upper arcuate taper 99 extending upwardly and inwardly from peripheral edge 97, and is provided with a lower arcuate taper 101 extending inwardly and downwardly from peripheral edge 97. Peripheral edge 97 along with tapers 99 and 101 extend outwardly beyond sidewall 95 and into a correspondingly shaped groove 103 provided on the inside of casing 13 adjacent the juncture of flanges 25, 27 where the juncture of the flanges 25, 27 with the vertical portions of the upper and lower casings 19, 21 are provided with radii, as best seen in FIG. 2. Thus, it will be seen that the peripheral edge 97 and the tapers 99, 101 of upper plate 85 are gripped by the inner distal edges of the upper and lower casings 19, 21 so that cartridge 15 is securely held against movement. Also, to the same effect is the clamping or gripping action of the steel band 29 which is V-shaped in cross-section, as thus seen in FIG. 2, so that there is a wedging action of the inner surfaces 105, 107 of band 29 against the flanges 25, 27 to cause tight clamping thereof. It will be seen that the inner surfaces 105, 107 are at an angle relative to one another.

There is a groove 109 around the periphery of the lower edge of upper plate 85 which receives an O-ring 111 that extends outwardly beyond the side wall 95 of cartridge 15 and into sealing engagement with the inner surface 113 of the side wall 115 of lower casing 21.

There are suitable means well known to those skilled in the art for fixedly holding upper plate 85, intermediate plate 89, lower plate 87, flexible diaphragm 91, and first gasket 93 together, and such means preferably comprises suitable bolts 117 respectively extending downwardly through apertures 119 in upper plate 85, apertures 121 in diaphragm 91, apertures 123 in intermediate plate 89, apertures 125 in first gasket 93, and apertures 127 in lower plate 87, and with nuts 129 threadedly engaged on the bolts 117 below lower plate 87 to clamp the parts together. Also, there is preferably a central bolt 131 extending downwardly through a central aperture 133 in upper plate 85, central aperture 135 in diaphragm 91, central aperture 137 in intermediate plate 89, central aperture 139 in first gasket 93, and central aperture 141 in lower plate 87 with a nut 143 engaged on the bolt 131 to clamp the central portion of the parts together. The heads of bolt 131, as well as the heads of bolts 117 are preferably embedded in the plastic material of upper plate 85.

The cartridge 15 includes an annular wall 145 integrally attached to lower plate 87 concentrically therewith at a place intermediate the center and the outer periphery of lower plate 87 and depending therefrom into engagement with a second gasket 147 sandwiched between the lower peripheral distal edge 145' of annular wall 145 and the bottom wall 149 of lower casing 21. Annular wall 145 and lower plate 87 divide the lower portion of cavity 23 into a central inlet chamber 151 and an outer annular outlet chamber 153.

There is an inlet port 155 in the center of wall 149 which communicates an inlet pipe means 157 with inlet chamber 151. The central opening 159 of second gasket 147 is in alignment with inlet port 155 so as not to block the flow of fluid from inlet pipe means 157 to inlet chamber 151.

Inlet pipe means 157 includes an enlarged upper portion 161 that has external threads 163 adapted to be threadedly engaged in the threaded bunghole B of a drum D. Inlet pipe means 157 is fixedly attached to the bottom surface of bottom wall 149 by suitable means well known to those skilled in the art, as for example by welding. Inlet pipe means 157 includes a depending portion 165 depending from enlarged upper portion 161 and preferably includes an inlet pipe extension 167 connected to depending portion 165 by suitable means at the upper end 169 thereof as by having external threads which are threadedly engaged with internal threads on the lower end 170 of depending portion 165. The open lower end, not shown, of inlet pipe extension 167 extends downwardly to a place adjacent the lower inside portion of the drum D for the reception of the chemicals carried by the drum D, which when pump 11 is operated, flow upwardly through inlet pipe means 157 into inlet chamber 151.

A bypass valve 171 is provided to bypass fluid back to inlet chamber 151 from outlet chamber 153 when the pressure in outlet chamber 153 rises above a selected point. Bypass valve 171 includes a valve member 173 having a valve face 175 which is preferably in the shape of a portion of a sphere that engages a correspondingly shaped aperture 177 through annular wall 145. Valve member 173 also includes a centering pin 179 and a base portion 181. Also, bypass valve 171 includes a spring 183 interposed between one side of the interior surface of annular wall 145 and base portion 181 to urge valve member 173 into the seated position shown in FIGS. 2 and 3.

An outlet port 185 is provided through a portion of side wall 186 in lower casing 21 below lower plate 87 to communicate outlet chamber 153 with outlet pipe means 187. Outlet pipe means 187 includes an extension 188, which leads to a suitable place or nozzle or the like not shown in order to dispense the chemicals and the like being pumped by pump 11.

Figure 9:
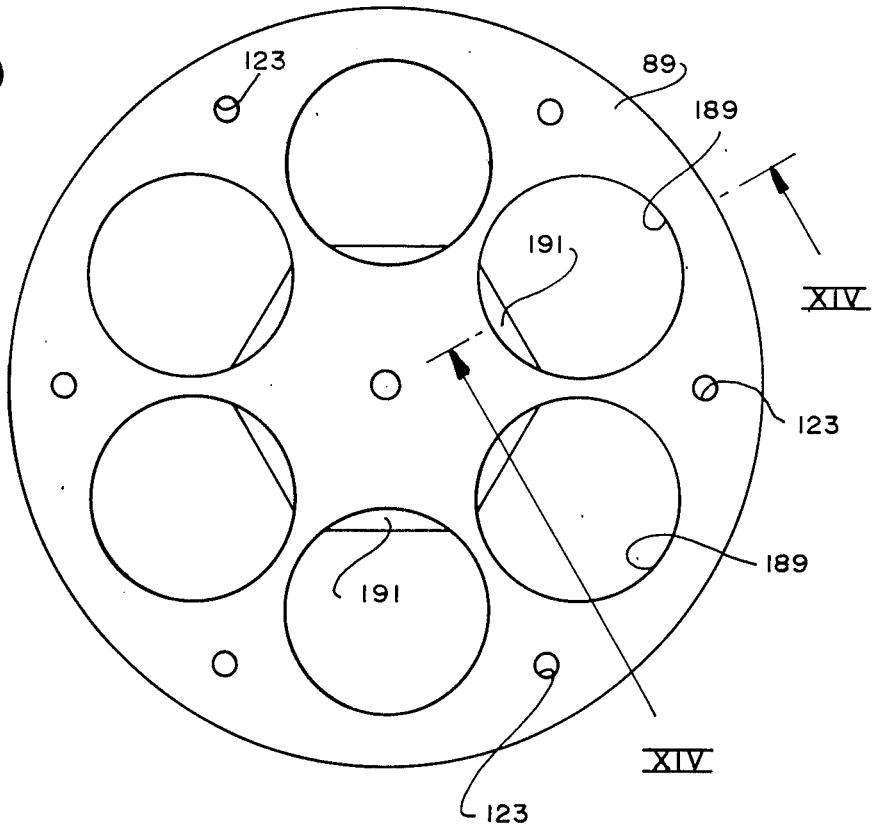
FIG. 9 is a top view of the intermediate plate of the cartridge.
Figure 10:
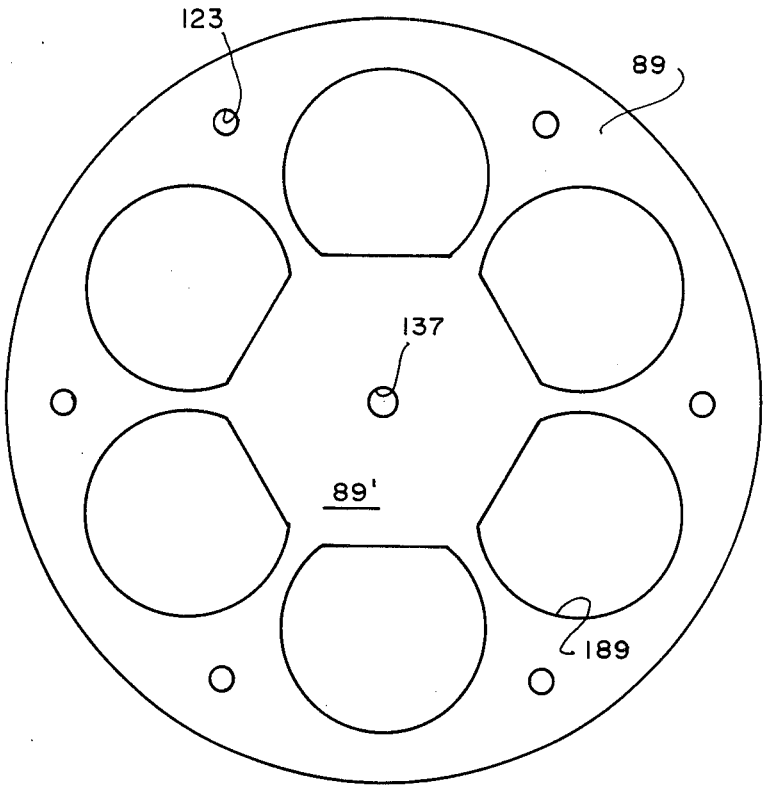
FIG. 10 is a bottom view of the intermediate plate of the cartridge.
Figure 11:
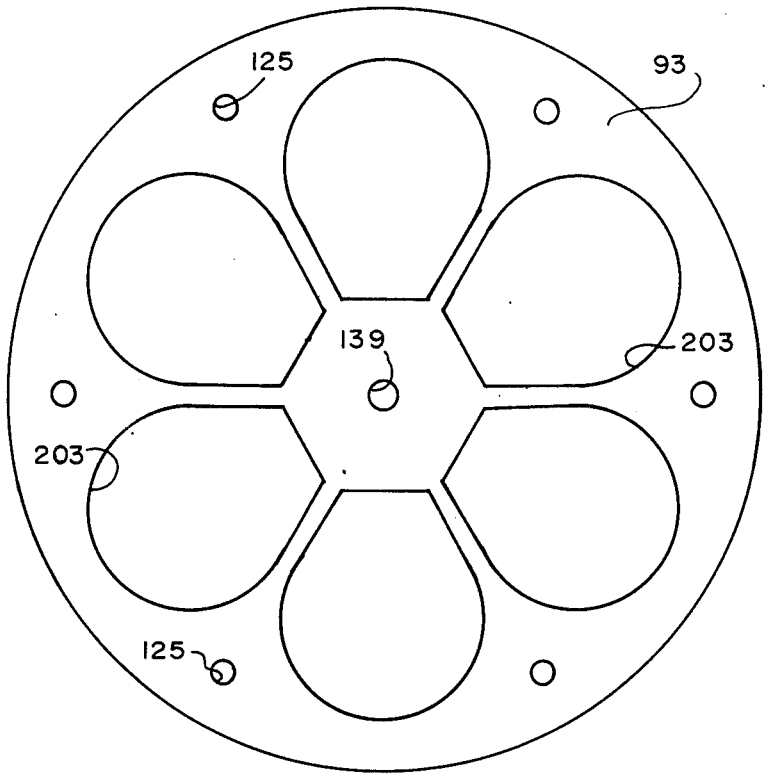
FIG. 11 is a top view of the upper gasket of the cartridge.
Figure 12:
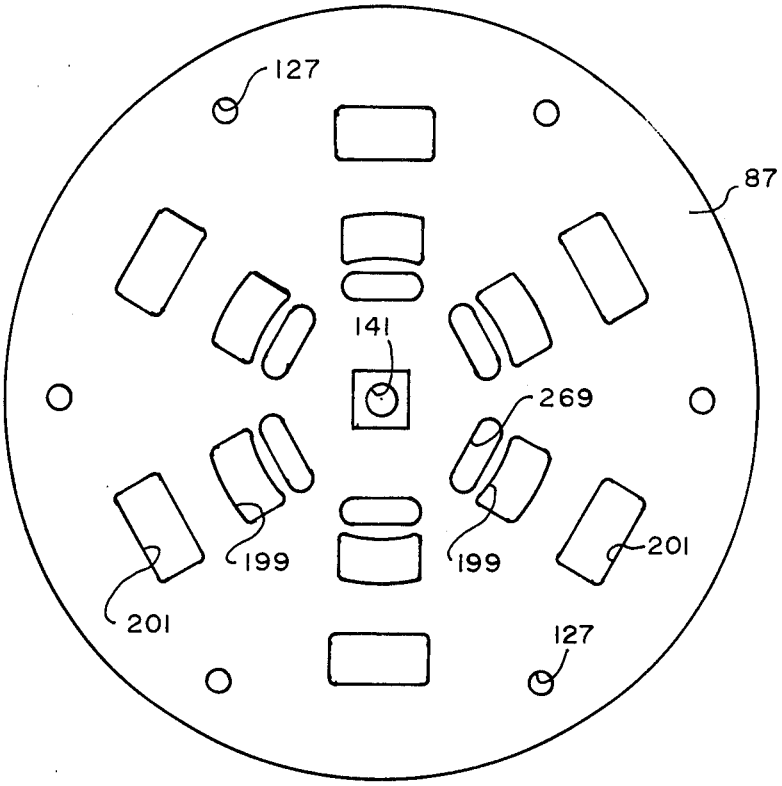
FIG. 12 is a top view of the lower plate of the cartridge.
Figure 13:
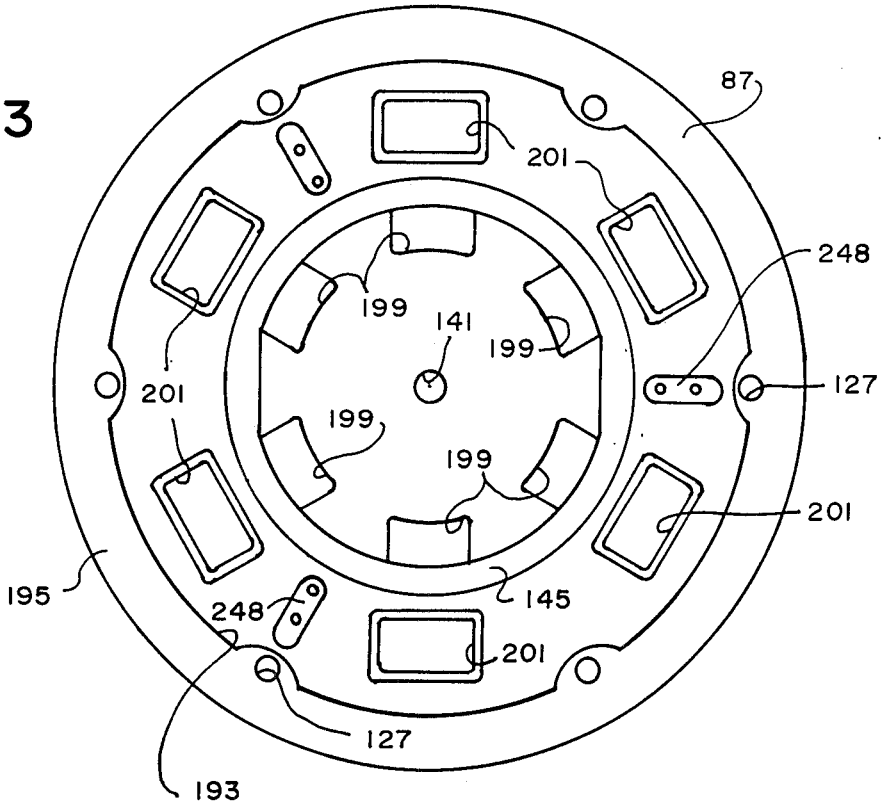
FIG. 13 is a bottom view of the lower plate of the cartridge.

Intermediate plate 89 (see FIGS. 9, 10 and 14) includes a plurality of circular openings 189 therethrough, which preferably are spaced evenly around the plate and are preferably, though not necessarily, six in number with the number depending upon the volume desired for the pump 11. Each of the openings 189 are provided with a stop 191 in the form of a step-like portion extending across a portion of the opening adjacent the lower surface 89' of intermediate plate 89 for a purpose later to be described.

Lower valve plate 87 (see FIGS. 13 and 28–30) include in the lower surface thereof an outer annular recess 193 formed by an annular peripheral wall 195 depending from the main body of valve plate 87 and extending to the upper portion of wall 145. A plurality of inlet apertures 199 are provided vertically through plate 87 from inlet chamber 151 to pump chambers 200. Inlet apertures 199 are of a like number as openings 189 and are disposed in substantial alignment therewith. Similarly, lower plate 87 has a plurality of outlet apertures 201 extending vertically therethrough from pump chambers 200 into outlet chamber 153 and which also are disposed in substantial alignment with openings 189 and are of a like number as openings 189.

First gasket 93 that fits between intermediate plate 89 and lower plate 87 is provided with a plurality of cutout portions 203 which correspond and are substantially in alignment with the respective openings 189.

Upper plate 85 is provided with a plurality of circular openings 203 substantially in alignment with openings 189, that is, the openings 203, 189 are disposed along the same vertical axes but openings 203 are smaller in diameter than openings 189. Also, it will be understood that there are the same number of openings 203 as openings 189.

There are a plurality of the piston means 69 respectively provided to operate through the circular openings 189. Thus, there are preferably six piston means 69 and the following description of one will suffice for all as they are substantially identical.

Piston means 69 (see FIGS. 15–21) includes a circular upper head means 205 disposed above diaphragm means 91, a centrally disposed rod means 207 which is connected to upper head means 205 concentrically therewith and upstanding therefrom. The means for connecting rod means 207 and upper head means 205 is preferably as follows: There is provided an annular piece 208 which is preferably integrally attached to the upper surface of upper head means 205 and extends upwardly therefrom and into which tightly fits the lower end 209 of rod means 207. The lower end 209 is preferably slightly tapered inwardly and downwardly so as to insure a tight fit with annular piece 208. In addition, piston means 69 includes a lower head means 211 below diaphgragm means 91 and in alignment with upper head means 205. Means is provided for urging upper head means 205 and lower head means 211 together to clamp a portion of diaphragm means 91 therebetween, which means preferably comprises a screw 213, that extends upwardly through a central aperture 215 in lower head means 211, an aperture 217 in diaphragm means 91, a central aperture 219 in upper head means 205, and is threadedly received in a central aperture 221 in the lower end 209 of rod means 207. Rod means 207 is preferably integrally formed and the upper portion 223 thereof is preferably provided with an enlarged annular portion 225 and a flange 227 thereabove. Also, centrally of upper portion 223 at the upper distal end thereof is provided a rounded projection 229.

Figure 6:
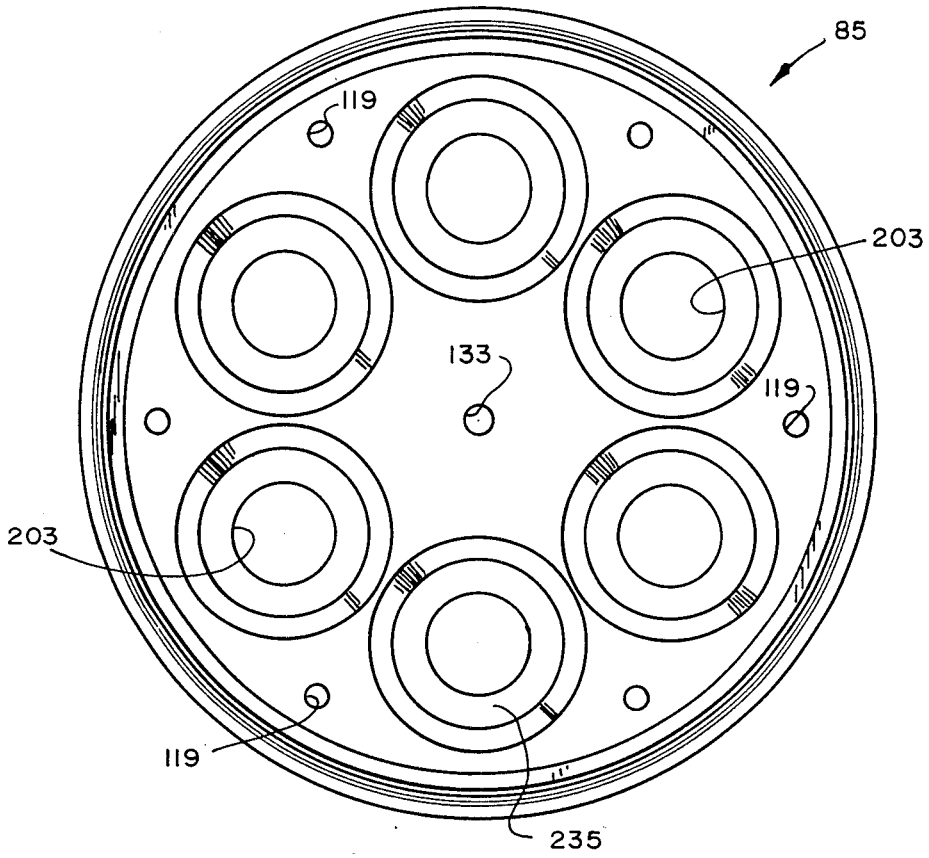
FIG. 6 is a bottom view of the upper plate of the cartridge.
Figure 7:
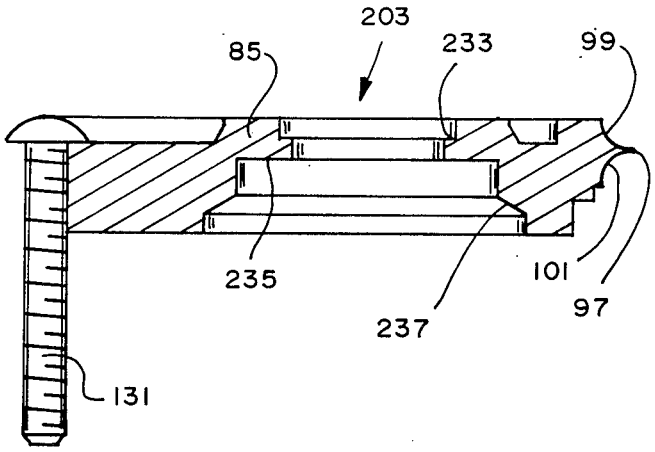
FIG. 7 is an enlarged sectional view taken as on the line VII—VII of FIG. 5.
Figure 8:
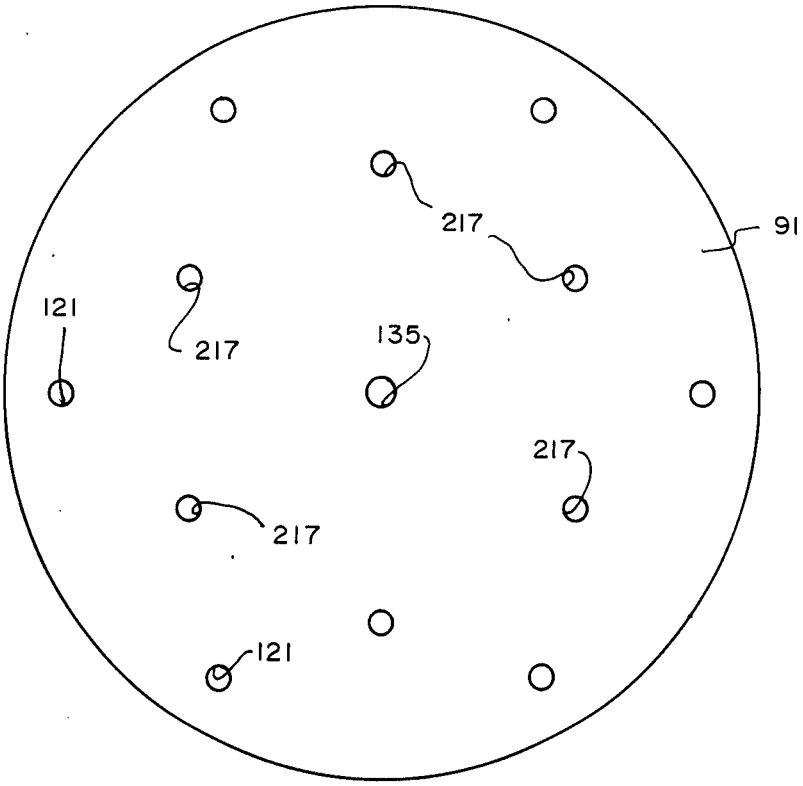
FIG. 8 is a top view of the diaphragm means.

Rod means 207 extends upwardly through opening 203 in upper plate 85 with upper portion 223 being above upper plate 85 and being adapted to be freely engaged by a dimpled portion 65 of swash plate 63 in a socket 67. A compression spring means 231 is provided around rod means 207. The upper end of spring means 231 extends around annular portion 225 and against the lower side of flange 227 which acts as a seat for the upper end of the spring means 231. The lower end of spring means 231 rests against a seat 233 provided in upper plate 85 around opening 203 (see FIG. 7). Additional seats 235 are provided in upper plate 85 respectively around openings 203 but are disposed below seats 233 and towards the lower side of upper plate 85 (see FIGS. 6 and 7). Each seat 235 is provided for the seating of upper head means 205 when the particular piston means 69 is in an upper position, as will be better understood in the description to follow. Also, upper plate 85 is flared outwardly and downwardly from seat 235 as at 237 to accommodate portions of the diaphragm means 91 when the piston means 69 is in said upper position.

A pump chamber 200 is provided beneath each of the piston means 69 and extends downwardly to lower plate 87. The chamber 200 is variable in size depending upon the position of the piston means 69. Thus, when a piston means 69 is in said upper position, the size or volume is at a maximum and when it is in a lowered position, it is at a minimum. Each of the chambers 200 is thus defined by portions of diaphragm means 91, lower head means 211, portions of the intermediate plate 89 which define openings 189, and portions of lower plate 87.

Figure 23:
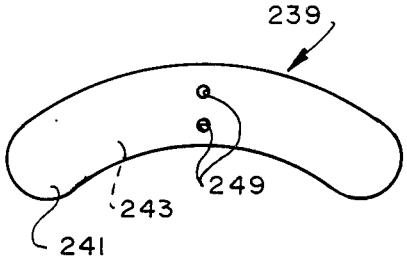
FIG. 23 is a plan view of the outlet valve means.
Figure 24:
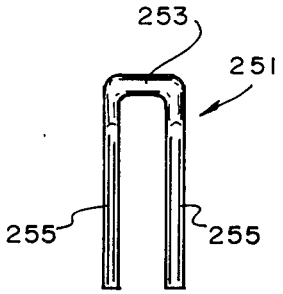
FIG. 24 is a front elevational view of one of the retaining pin means for the outlet valve means.

A plurality of spring actuated outlet valve means 239 (see, in general, FIGS. 23, 28 and 29) operate respectively with outlet apertures 201 for the opening and closing thereof to govern flow from pump chamber 200 to outlet chamber 153. The outlet valve means 239 to the left in FIG. 3 is shown in an open position and the one to the right is shown in a closed position. Outlet valve means 239 are preferably arranged in pairs with each of the pairs including an arcuate flat and resilient upper leaf spring 241 and an arcuate flat and resilient lower leaf spring 243 which is preferably of the same size and shape as upper leaf spring 241 and is disposed in flat face to face engagement therewith (see, in general, FIGS. 23 and 29). Upper leaf spring 241 is of a lesser thickness than lower leaf spring 243. A preferable thickness for leaf spring 241 is five thousandths of an inch and the preferable thickness of leaf spring 243 is ten thousandths of an inch; and both are preferably formed of resilient spring steel. It has been found that with the use of a thin leaf spring as leaf spring 241 above the thicker leaf spring 243 that the resulting spring actuated valve means 239 is durable and much more so than a single leaf spring.

Figure 25:
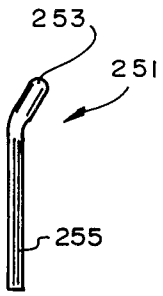
FIG. 25 is a side elevational view of that shown in FIG. 24.
Figure 28:
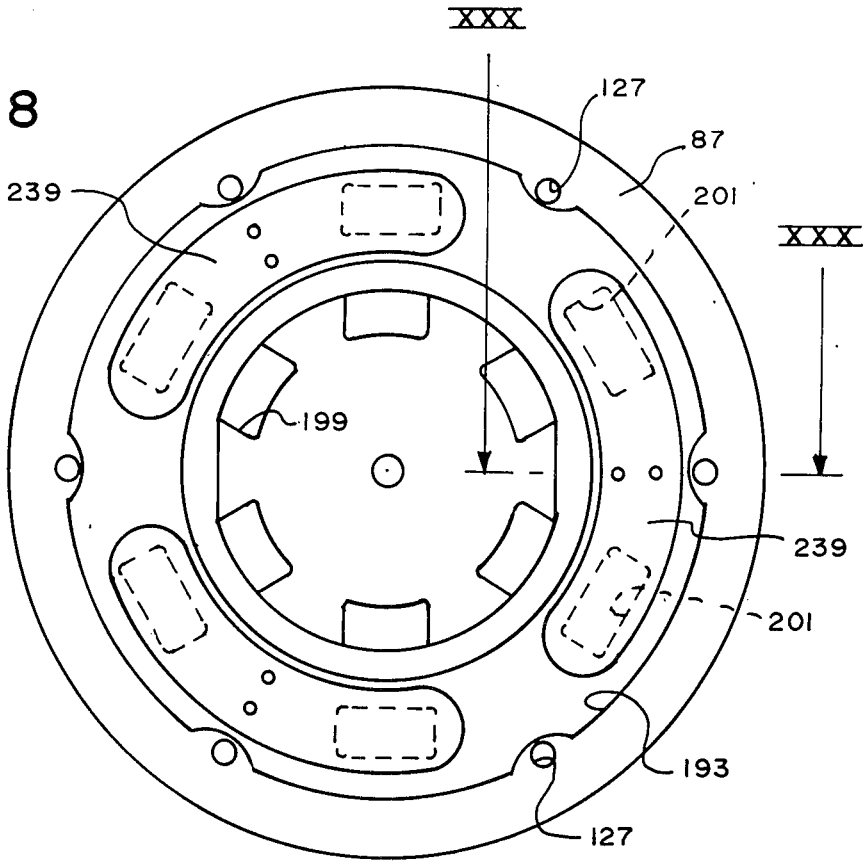
FIG. 28 is a bottom view of that shown in FIG. 27 with the outlet valve means shown in place but with the attaching means being removed and showing the outlet valve apertures in broken lines.
Figure 29:
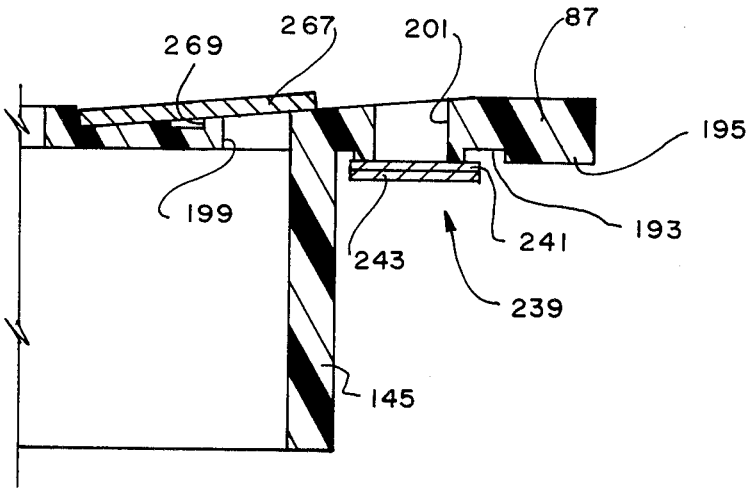
FIG. 29 is an enlarged sectional view taken as on the line XXIX—XXIX of FIG. 27.
Figure 30:
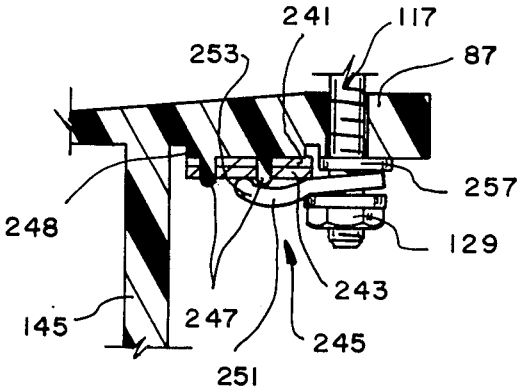
FIG. 30 is an enlarged sectional view taken as on the line XXX—XXX of FIG. 28.

Attaching means 245 (see, in general, FIG. 30) is provided for attaching leaf springs 241, 243 to lower plate 87. Attaching means 245 preferably includes pin means 247 extending through hole means 249 provided intermediate the ends of leaf springs 241, 243. There are preferably a pair of each pin means 247 and hole means 249 as the attaching means 245 for each pair of leaf springs 241, 243. Each pin means 247 is preferably formed integrally at the upper end thereof with lower plate 87 at a thickened portion 248 of plate 87 and the body of pin means 247 is preferably cylindrical with the distal end being rounded. In addition, attaching means 245 includes a plurality of holding clips 251 respectively engaging lower leaf springs 243 between each pair of pin means 247. Each of the holding clips 251 is preferably U-shaped and includes an intermediate portion 253 with a pair of legs 255 extending therefrom. The holding clips 251 are preferably made of steel wire and the intermediate portion 253 is preferably at an angle relative to legs 255, as best seen in FIG. 25. When installed, each of the holding clips 251 are retained in place by the legs 255 extending on either side of bolts 117 between washers 257 provided on bolts 117, as best seen in FIG. 30, with the legs being clamped in place by the nut 129 and with the intermediate portion 253 pressing against lower leaf spring 243 between pin means 247 as best seen in FIG. 30. The above-described attaching means 245 provides a very efficient yet quick and simple means of assembly of valve means 239. Leaf springs 241, 243 are positioned directly in line, one above the other with the leaf springs adjacent the opposite ends thereof remote from attaching means 245 underlying respectively a pair of outlet apertures 201, as best seen in FIG. 28. Thus, the distal ends of the upper and lower leaf springs 241, 243 normally close the outlet apertures 201 to prevent the flow upwardly through the apertures from outlet chamber 153 but permit flow downwardly from pump chambers 200 through the apertures into outlet chamber 153. It will be understood that the inherent resiliency of the steel leaf springs will return the leaf springs to a closed position relative to the outlet apertures 201 when there is no flow passing therethrough. Thus, it will be understood that the outlet valve means 239 is biased towards a closed position.

Figure 27:
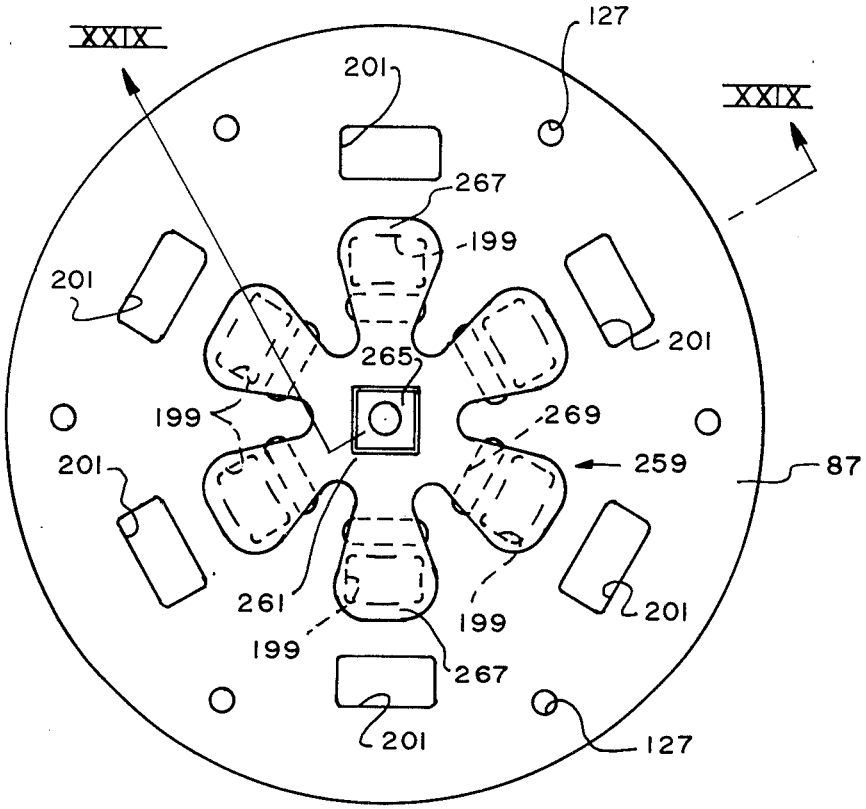
FIG. 27 is a plan view of the lower plate of the cartridge with the inlet valve means being shown in place and with the recesses and inlet apertures being shown in broken lines.

A plurality of spring actuated valve means 259 operate respectively in conjunction with inlet apertures 199 for the opening and closing thereof to govern flow from inlet chamber 151 to pump chambers 200. Inlet valve means 259 are preferably formed from a single piece of spring steel (see FIG. 27) which is preferably five thousandths of an inch thick. The center portion 261 of inlet valve means 259 is attached to the top side of lower plate 87 by bolt 131 extending through an aperture 263 through center portion 261. Aperture 261 is preferably square as best seen in FIG. 22 to receive a square portion 265 provided on the upper surface of lower plate 87 adjacent the center thereof to hold the inlet valve means 259 in place and prevent turning thereof. Each of inlet valve means 259 includes a resilient spring flap 267 extending radially outwardly from center portion 261 and formed integrally therewith. Also, each of the spring flaps 267 are biased towards closure of its associated inlet aperture 199. In other words, the spring flaps 267 are arranged so that they extend radially outwardly adjacent the upper surface of lower plate 87 with the respective distal ends of flaps 267 being disposed adjacent and over an associated inlet aperture 199.

There is a recess 269 in the upper surface of lower plate 87 beneath each of the spring flaps 267 inwardly of inlet apertures 199 to prevent build-up of chemicals beneath flaps 267 which might otherwise occur and prevent seating of flaps 267 over apertures 199.

When the user receives a drum D, it will have a suitable plug or cap in the bunghole B which is removed and then the inlet pipe means 157 is inserted through the hole B and screwed into place. Next, to prepare for the operation of pump 11, the user simply turns on the motor 47 which causes swash plate means 63 to wobble and cause upward and downward movement of the piston means 69. It will be understood that the upward and downward movement of piston means 69 is limited by the stroke of swash plate means 63. This in turn causes the liquid chemical to be drawn up through the intake pipe means 157 into the inlet chamber 151 due to the pumping action of the piston means 69. It will be understood that when a piston means 69 moves upwardly, it will cause a suction action to pull the liquid chemical through pipe means 157, inlet chamber 151, through inlet apertures 199, whereupon it lifts spring flaps 267 so that the liquid passes into pump chamber 200. This action is shown in FIG. 3 wherein it will be seen that the piston means 69 to the right has substantially moved into said raised position drawing liquid into chamber 200 through inlet aperture 199, which is shown open or unblocked by the raised flap 267. Then downward movement of the piston means 69 causes pressure in chamber 200 to close the spring flap 267 and open leaf springs 241, 243 to move the liquid chemical through the outlet aperture 201 into the outlet chamber 153, outlet port 185 and outlet pipe means 187 to the place of delivery. This action is shown in FIG. 3 wherein it will be seen that the piston means 69 to the left is forcing liquid against outlet valve means 239 to open same and allow the liquid to flow from pump chamber 200 through the open or unblocked outlet aperture 201. From outlet pipe means 187 the liquid is forced through the counter or other auxiliary equipment, not shown, and through the dispensing nozzle, not shown, and into the desired place of use, as a tank, spray equipment or the like.

It will be understood that when the user has different types of chemicals to be dispensed from different drums D, he may leave the lower casing 21 with the cartridge 15 therein, loosen clamping device 33 to allow removal of upper casing 19 and driving means 17. Thus, the driving means 17 and upper casing 19 can be moved to the next drum D having chemicals to be dispensed without intermingling the residual chemicals in the lower casing 21 and cartridge 15 so that the chemicals will not become mixed and yet the user only needs to buy one driving means and associated upper casing 19 which is by far the most expensive part of the pump 11.

In addition, it will be seen that when the cartridge 15 wears out, it can be quickly and easily replaced by simply loosening the clamping device 33, removing the upper casing 19 from the lower casing 21, removing the worn out cartridge 15 and replacing same with another cartridge 15, and then replacing upper casing 19 and tightening clamping device 33.

From the foregoing it will be understood that pump 11 provides a very efficient and safe system which is very economical to operate. Thus, the pump 11 of the present invention provides an outside stainless steel casing 13 that receives no wear due to pumping action, but the part that does receive wear, namely the cartridge 15, is easily inserted and removed from the casing 13 so that it is not necessary to buy a whole new pump but just replace the cartridge 15 therein. Also, it will be understood that pump 11 is so efficient that lower power such as 12 volts can be used and which requires only low amperage for the motor 47. In addition, the pump 11 of the present invention is particularly adapted for pumping heavy viscous chemicals and the like.

Although the present invention has been described and illustrated with respect to a preferred embodiment thereof and a preferred use therefor, it is not to be so limited since changes and modifications can be made therein which are within the full intended scope of the invention.

I claim:

1. A diaphragm pump for pumping liquid, said pump comprising:

(a) casing means including a first casing and a second casing and having an inlet port and an outlet port;

(b) coupling means detachably coupling said first and second casings to one another for casing said first and second casings to coact to define an internal cavity with said inlet and outlet ports communicating with said cavity and for allowing said first and second casings to be quickly detached from and coupled to one another, said cavity being exposed when said first and second casings are detached from one another;

(c) unitary replaceable cartridge means mounted within said cavity for drawing liquid into said cavity through said inlet port and for pumping liquid out of said cavity through said outlet port, said cartridge means being freely slidable into and out of said cavity as an integral, unitary part when said first and second casings are detached from one another without requiring any mechanical decoupling of said cartridge means from said casing means other than the decoupling of said coupling means for allowing the quick placement and removal thereof from said cavity, said cartridge means including piston means movable between first and second positions for causing liquid to be drawn into said cavity through said inlet port and pumped out of said cavity through said outlet port; and (d) driving means attached to said casing means for removably engaging portions of said piston means for the selective driving thereof between said first and second positions when said cartridge means is positioned within said cavity and said first and second casings are coupled to one another by said coupling means.

2. The pump of claim 1 in which said cartridge means includes a depending annular wall having a lower distal edge engaging said first casing to establish therewith an inlet chamber and a separate outlet chamber for liquids.

3. The pump of claim 1 in which said first casing and said second casing are respectively provided with matching outwardly projecting abutting flanges establishing a groove on the interior of said casing means, and in which said cartridge means is provided with a peripheral flange means fitting into said groove for the anchoring of said cartridge means in said cavity.

4. The pump of claim 3 in which is provided a V-shaped band means having angular inner surfaces engaging respectively said flanges for the clamping together thereof.

5. A diaphragm pump for heavy viscous chemicals and the like comprising unitary replaceable cartridge means for pumping heavy viscous chemicals and the like including diaphragm means, means establishing a plurality of pump chambers, a plurality of piston means attached to said diaphragm means and respectively operating in conjunction with said pump chambers, said piston means being respectively movable between raised positions and lowered positions in said pump chambers, each of said piston means including spring means associated therewith for moving each of said pump means to a raised position; casing means including a lower casing and an upper casing; a motor means including a rotatable shaft; nonrotatable swash plate means attached to said shaft; means attaching said motor means to said upper casing; and coupling means detachably coupling said upper casing and said lower casing together to establish a hollow cavity in said casing means removably containing said unitary cartridge means with said swash plate means freely engaging said piston means for successively moving said piston means into said lowered position and for subsequently allowing said piston means to successively move into said raised position, and for allowing said upper casing to be quickly detached from and coupled to said lower casing for the quick replacement of said cartridge means; said cartridge means being freely slidable into and out of said cavity as an integral, unitary part when said upper and lower casings, are detached from one another without requiring any mechanical decoupling of said cartridge means from said casing means other than the decoupling of said coupling means.

6. The pump of claim 5 in which said lower casing and said upper casing are respectively provided with matching outwardly projecting mating flanges establishing a groove on the interior of said casing means, and in which said cartridge means is provided with a peripheral flange means fitting into said groove for the anchoring of said cartridge means in said cavity.

7. The pump of claim 5 in which said cartridge means includes a depending annular wall dividing the lower portion of said cavity into an intake chamber and an outlet chamber, an inlet pipe means attached to said lower casing, an inlet port in said lower casing communicating said inlet pipe means with said intake chamber, an outlet pipe means attached to said lower casing, and an outlet port in said lower casing communicating said outlet chamber with said outlet pipe means.

8. The combination of claim 7 which includes by-pass valve means for by-passing fluids from said outlet chamber to said inlet chamber.

9. The pump of claim 7 in which said lower chamber includes a bottom wall, said depending annular wall includes a lower distal edge, and in which is included seal means interposed between said lower distal edge of said annular wall and said bottom wall to seal against leakage between said lower distal edge of said annular wall and said bottom wall.

* * * * *